US010472138B2

(12) United States Patent
Smith

(10) Patent No.: US 10,472,138 B2
(45) Date of Patent: Nov. 12, 2019

(54) SYSTEMS AND METHODS FOR A DEVICE WITH AN INTERNAL VENTED NOZZLE

(71) Applicant: Donny Smith, San Saba, TX (US)

(72) Inventor: Donny Smith, San Saba, TX (US)

( * ) Notice: Subject to any disclaimer, the term of this patent is extended or adjusted under 35 U.S.C. 154(b) by 0 days.

(21) Appl. No.: 16/153,868

(22) Filed: Oct. 8, 2018

(65) Prior Publication Data

US 2019/0112111 A1 Apr. 18, 2019

Related U.S. Application Data

(60) Provisional application No. 62/571,632, filed on Oct. 12, 2017.

(51) Int. Cl.

| | |
|---|---|
| ***B65D 47/06*** | (2006.01) |
| ***B65D 25/48*** | (2006.01) |
| ***B65D 47/32*** | (2006.01) |
| ***B05C 17/005*** | (2006.01) |

(52) U.S. Cl.

CPC ..... *B65D 47/063* (2013.01); *B05C 17/00503* (2013.01); *B65D 25/48* (2013.01); *B65D 47/066* (2013.01); *B65D 47/32* (2013.01); *B65D 2205/00* (2013.01); *B65D 2539/001* (2013.01)

(58) Field of Classification Search

CPC ..... B65D 47/063; B65D 47/066; B65D 47/32
USPC ..... 222/527, 478–489, 566–574
See application file for complete search history.

(56) References Cited

U.S. PATENT DOCUMENTS

| | | | | | |
|---|---|---|---|---|---|
| 523,918 | A | | 7/1894 | Palmer | |
| 1,517,644 | A | * | 12/1924 | Kruger | B65D 47/06 141/309 |
| 1,523,696 | A | * | 1/1925 | Lewis | B65D 25/48 141/309 |
| 1,849,950 | A | * | 3/1932 | Murdock | B65D 47/16 141/309 |
| 2,790,582 | A | | 12/1954 | Halpern | |
| 2,898,014 | A | * | 8/1959 | Borah | B65D 47/063 222/481.5 |
| 3,000,544 | A | | 9/1961 | Roberts | |
| 3,901,417 | A | * | 8/1975 | Schiemann | B65D 1/20 222/479 |
| 4,241,855 | A | | 12/1980 | Yoshioka | |
| 4,426,027 | A | * | 1/1984 | Maynard, Jr. | B65D 47/063 222/529 |
| 4,492,324 | A | * | 1/1985 | Weber | B65D 25/44 222/529 |
| 4,597,513 | A | * | 7/1986 | Schiemann | B65D 47/06 222/478 |
| 4,671,328 | A | * | 6/1987 | Mueller | A61M 16/183 141/1 |
| 4,856,664 | A | * | 8/1989 | Gillispie | B65D 1/20 222/572 |
| 4,886,194 | A | * | 12/1989 | Schiemann | B65D 25/48 222/478 |
| 4,946,079 | A | * | 8/1990 | Campbell | B67D 3/048 222/484 |

(Continued)

*Primary Examiner* — Patrick M. Buechner
*Assistant Examiner* — Michael J. Melaragno
(74) *Attorney, Agent, or Firm* — Pierson IP, PLLC

(57) ABSTRACT

Examples of the present disclosure are related to systems and methods for a pouring device with an internal vented nozzle. More particularly, embodiments relate to a nozzle that is partitioned by an internal sidewall that extends across a chord of a circumference of the nozzle that allows for a vented nozzle with a larger diameter.

6 Claims, 3 Drawing Sheets

(56) References Cited

U.S. PATENT DOCUMENTS 5,097,994 A * 3/1992 Washam ..... B65D 47/063 222/527
5,186,358 A * 2/1993 McVay ..... B67C 11/02 141/332
5,350,091 A * 9/1994 Leete ..... B65D 25/385 141/337
5,722,570 A * 3/1998 Sultzer, III ..... B65D 47/063 222/529
6,230,944 B1 5/2001 Castellano et al.
6,364,178 B1 4/2002 Paczonay
7,044,342 B2 * 5/2006 Carlton ..... B67D 7/005 222/481.5
8,727,187 B2 * 5/2014 Magley, II ..... B65D 47/32 222/481.5
9,096,357 B2 * 8/2015 Brausen ..... B65D 47/32
9,796,506 B2 * 10/2017 Meager ..... B65D 23/04
2004/0045928 A1 * 3/2004 Lepage ..... B65D 47/06 215/388
2004/0084485 A1 * 5/2004 Carlton ..... B67D 7/005 222/527
2006/0081662 A1 * 4/2006 Miura ..... B65D 1/023 222/481.5
2008/0099516 A1 * 5/2008 Lacoste ..... A01M 1/245 222/527
2011/0147405 A1 6/2011 Blinn
2012/0085792 A1 * 4/2012 Carriere ..... B65D 25/44 222/527
2013/0048591 A1 2/2013 Morrone
2013/0056503 A1 3/2013 Hagen
2013/0299522 A1 * 11/2013 Magley, II ..... B65D 47/32 222/481.5
2014/0144948 A1 * 5/2014 Brausen ..... B65D 47/32 222/468
2014/0190922 A1 7/2014 Rhodes et al.
2014/0190988 A1 7/2014 Hickey
2014/0332568 A1 11/2014 Stratton
2014/0353222 A1 12/2014 Sabin
2016/0060005 A1 * 3/2016 Dodia ..... B65D 47/32 222/478
2016/0272371 A1 * 9/2016 Crosby ..... B65D 25/48
2017/0305604 A1 * 10/2017 Sessions ..... B65D 47/063
2018/0346209 A1 * 12/2018 Bongiovanni ..... B65D 47/122
2019/0031403 A1 * 1/2019 Sessions ..... B65D 25/44

* cited by examiner

SYSTEMS AND METHODS FOR A DEVICE WITH AN INTERNAL VENTED NOZZLE

CROSS-REFERENCE TO RELATED APPLICATIONS

This application claims a benefit of priority under 35 U.S.C. § 119 to Provisional Application No. 62/571,632 filed on Oct. 12, 2017, entitled "SYSTEMS AND METHODS FOR A DEVICE WITH AN INTERNAL VENTED NOZZLE," which is fully incorporated herein by reference in its entirety.

BACKGROUND INFORMATION

Field of the Disclosure

Examples of the present disclosure are related to systems and methods for a pouring device with an internal vented nozzle. More particularly, embodiments relate to a nozzle that is partitioned by an internal sidewall that extends across a chord of a circumference of the nozzle that allows for a vented nozzle with a larger diameter, wherein the chord is offset from a diameter of the nozzle.

Background

Liquid containers generally include a nozzle, spout, or pouring device to facilitate the directing of liquid from a first container to a second container. Some conventional liquid containers include a vent. The vent allows air to be displaced as fluid flows into or out of the liquid container. However, the vents on conventional pouring devices are typically located away from a point of pouring or nozzle, and thus are not located internally within the nozzle of the container. Furthermore, conventional liquid containers with nozzles do not maximize a full circumference of the nozzle to dispense liquid.

Accordingly, needs exist for more effective and efficient systems and methods for a pouring device with a nozzle, the nozzle including an air vent and a dispensing port that are partitioned by a sidewall, wherein the sidewall extends across a chord of the circumference of the nozzle.

SUMMARY

Examples of the present disclosure are related to systems and methods for a pouring device with an internal vented nozzle. More particularly, embodiments relate to a nozzle that is partitioned by an internal sidewall that extends across a chord of a circumference of the nozzle that allows for a vented nozzle with a larger diameter. The internal sidewall may be configured to allow a flow of fluid in a first direction through a first partition and a flow of air in a second direction through a second partition.

In embodiments, a pouring device may include an inlet, a corrugated portion, and a nozzle.

The inlet may be positioned on a proximal end of the pouring device, and may be configured to be coupled with a liquid container, such as a jug, pitcher, etc. The inlet may include a coupling device, such as threads, press fit connector, etc., that are configured to receive corresponding coupling devices on the liquid container. The inlet may include a first portion with a first length and a first circumference, and a second portion with a second length and a second circumference, wherein the first length and first circumference are greater than the second length and the second circumference.

The corrugated portion may be a flexible material that extends from the inlet to the nozzle. The corrugated portion may include a series of parallel ridges and furrows that allow the corrugated portion to expand and contract. When the corrugated portion is expanded, the length of the corrugated portion may increase by increasing the distance between adjacent ridges. When the corrugated portion is contracted, the length of the corrugated portion may decrease by decreasing the distance between adjacent ridges. The corrugated portion may have third circumferences extending across the ridges, and fourth circumferences extending across the furrow. In embodiments, the third circumferences may be greater than the first circumference, and the fourth circumferences may be less than the first circumference. The differences in diameters may creates waves within the liquid that can be displaced by air, which may create a smoother pour.

The nozzle may be positioned on a distal end of the pouring device, which may be adjacent to a second end of the corrugated portion. The nozzle may be configured to allow air to enter into the pouring device while liquid is dispensed from the nozzle. The nozzle may include a first end, tapered portion, and shaft.

The first end may be positioned adjacent to the second end of the corrugated portion, and include a fifth circumference and a fifth length, wherein the fifth circumference may be greater than the third circumferences and less than the fourth circumferences.

The tapered portion may include tapered sidewalls to decrease the circumference of the nozzle from the first end to the second end of the nozzle. This may assist in the flowing of fluid towards and through the shaft, and assist in air flowing into the corrugated portion from the shaft.

The shaft may be positioned on a distal end of the nozzle. The shaft may include an internal partitioning that is created by a sidewall, wherein the sidewall extends across a chord of the shaft. The sidewall may partition the shaft into an air vent and a dispensing port, wherein a first area of the dispensing port is greater a second area of the air vent.

In embodiments, the sidewall may be offset from the first end of the shaft and a second end of the shaft, such that the sidewall does not extend across the entire longitudinal axis of the shaft. The may allow air to displace the dispensed liquid at locations proximate to a location where the liquid is poured out of the nozzle. Furthermore, the sidewall may include internal notches that are positioned on both sides of the sidewall, such that the sidewall is not planar.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
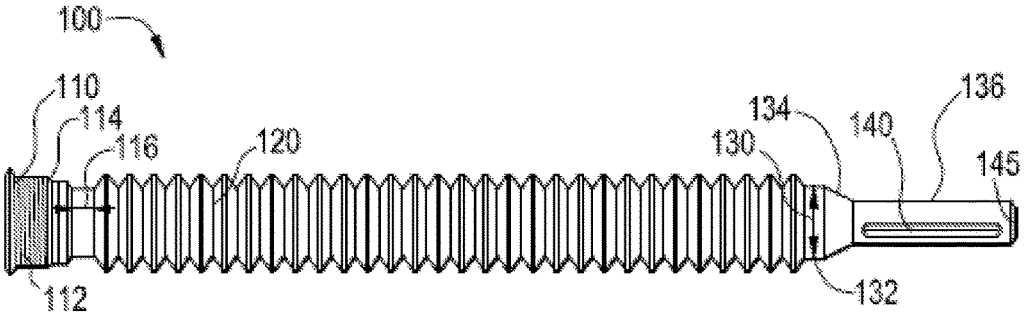
FIG. 1 depicts a pouring device, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

FIG. 1 depicts a pouring device 100, according to an embodiment. Pouring device 100 may be configured to allow a user to dispense fluids from a liquid container (not shown) more efficiently. Pouring device 100 may include a hollow inner chamber extending from a proximal end to a distal end of pouring device 100, wherein the hollow chamber has different circumferences from the proximal end to the distal end. Pouring device 100 may include an inlet 110, corrugated portion 120, and nozzle 130.

Inlet 110 may be positioned on a proximal end of the pouring device, and may be configured to be coupled to the liquid container. A first end of inlet may include a coupling device 112, such as threads, press fit connector, etc. The coupling device 112 may be configured to receiving corresponding coupling devices on the liquid container. Inlet 110 may include a first portion 114 with a first length and a first circumference, and a second portion 116 with a second length and a second circumference, wherein the first length and first circumference are greater than the second length and the second circumference. In embodiments, inlet 110 may include an internal rubber seal. This may allow inlet 110 to be coupled directly against another spout, outlet, nozzle, etc.

Corrugated portion 120 may be a flexible material that extends from the inlet to the nozzle. Corrugated portion 120 includes a series of parallel ridges and furrows that allow the corrugated portion to expand and contract. When corrugated portion 120 is expanded, the length of the corrugated portion 120 may increase by increasing the distance between adjacent ridges. When corrugated portion 120 is contracted, the length of corrugated portion 120 may decreased by decreasing the distance between adjacent ridges. Corrugated portion 120 may have third circumferences extending across the ridges, and fourth circumferences extending across the furrow. In embodiments, the third circumferences may be greater than the first circumference, and the fourth circumferences may be less than the first circumference.

Nozzle 130 may be positioned on a distal end of pouring device 100, which may be adjacent to a second end of corrugated portion 120. Nozzle 130 may be configured to allow air to enter into pouring device 100 while liquid is dispensed from nozzle 120. The nozzle may include a first end 132, tapered portion 134, and shaft 136.

First end 132 may be positioned adjacent to the second end of the corrugated portion 120, and include a fifth circumference and a fifth length, wherein the fifth circumference may be greater than the third circumferences and less than the fourth circumferences.

Tapered portion 134 may be positioned between first end 132 and shaft 136, and may include tapered sidewalls to decrease the circumference of nozzle 130 from the first end 132 to the second end 145 of nozzle 130. This may assist in the flowing of fluid towards and through shaft 136, and assist in air flowing into corrugated portion 120 from shaft 136.

Shaft 136 may be positioned on a distal end of the nozzle. Shaft 136 may be configured to allow liquid to exit out of nozzle 130 via second end 145, and allow air to enter into nozzle 130 via second end. Shaft 136 may be substantially cylindrical in shape, and have a substantially constant fifth circumference. The fifth circumference may be smaller than that of the other circumferences.

Shaft 136 may include an internal partitioning that is created by a sidewall 140 that extends across an internal chord of shaft 136. Sidewall 140 may partition the shaft into an air vent and a dispensing port, wherein a first area of the dispensing port is greater a second area of the air vent. In embodiments, sidewall 140 may be offset from the first end of the shaft and second end 145 of the shaft 136, such that sidewall 140 does not extend across the entire longitudinal axis of shaft 136. This may create internal areas within shaft 136 that do not include sidewall 140. Furthermore, sidewall 140 may create depressions, grooves, etc. on the outer diameter of shaft 136 that extend along the longitudinal axis of shaft 136. The depressions may assist a user in gripping nozzle 130.

Figure 2:
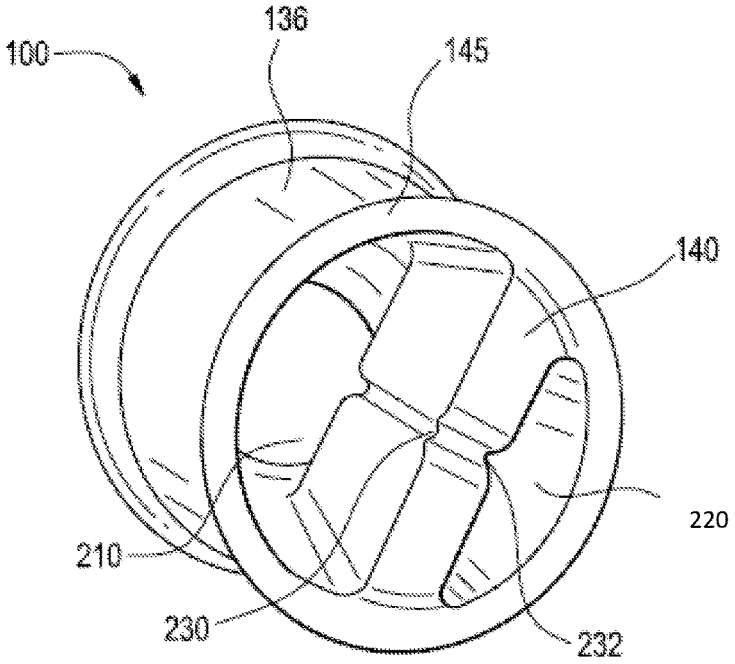
FIG. 2 depicts a bottom view of pouring device, according to an embodiment.

FIG. 2 depicts a front view of pouring device 100, according to an embodiment. Elements depicted in FIG. 2 may be described above, and for the sake of brevity, another description of those elements may be omitted.

As depicted in FIG. 2, sidewall 140 may extend across a chord a circumference of shaft 136 at a position that is proximate to second end 145 of nozzle. The chord may partition shaft 136 into two separate sections having different areas. Dispensing port 210 may be formed with a larger area than a air vent 220.

As further depicted in FIG. 2, sidewall 140 may include ridges 230, 232 that extend along a central axis of sidewall 140. Ridges 230, 232 may be concave indentions that allow liquid and air to more easily flow into and out of shaft 136. However, in other embodiments, sidewall 140 may have planar sidewalls without indentions.

Figure 3:
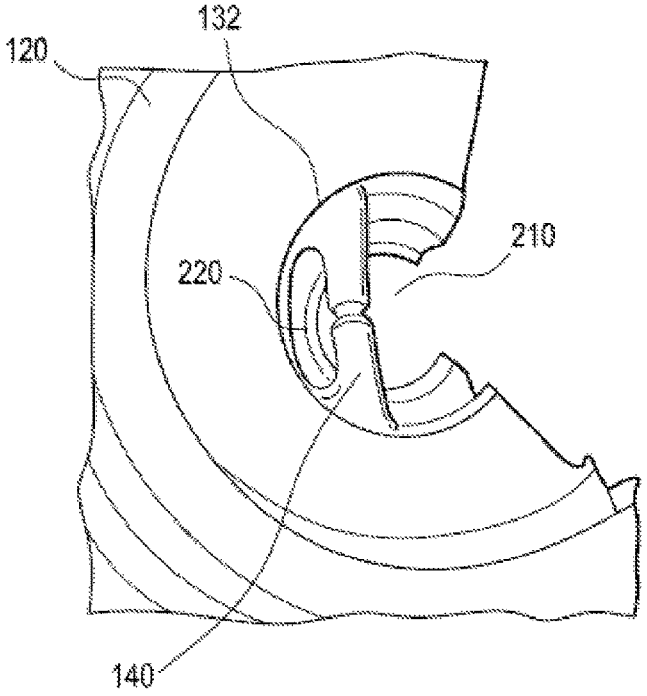
FIG. 3 depicts an upper view pouring device, according to an embodiment.

FIG. 3 depicts an inner cross sectional view of pouring device 100 with portions of pouring device 100 removed for ease of view, according to an embodiment. Elements depicted in FIG. 2 may be described above, and for the sake of brevity, another description of those elements may be omitted.

As depicted in FIG. 3, sidewall 140 may not extend across the entire longitudinal axis of shaft 136. Thus, portions of inner diameter of shaft 136 may not include sidewall 140.

This may allow air and liquid to more easily enter and exit pouring device 100 at a position within the inner diameter of shaft 136.

Figure 4:
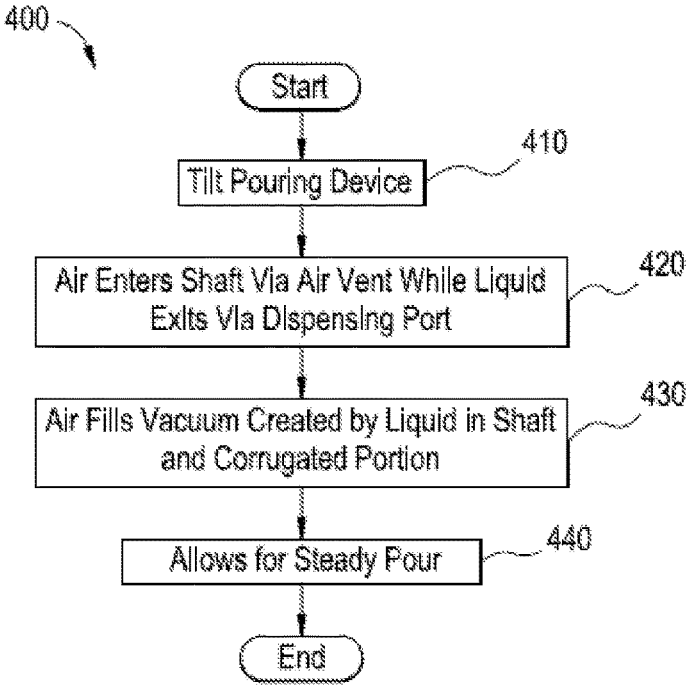
FIG. 4 depicts method for utilizing a pouring device, according to an embodiment.

FIG. 4 depicts a method 400 for utilizing an internal vent in a pouring device, according to an embodiment. The operations of the method depicted in FIG. 4 are intended to be illustrative. In some embodiments, the method may be accomplished with one or more additional operations not described, and/or without one or more of the operations discussed. Additionally, the order in which the operations of the method are illustrated in FIG. 4 and described below is not intended to be limiting. Elements depicted in FIG. 4 may be described above. For the sake of brevity, a further description of these elements is omitted.

At operation 410, a pouring device and nozzle may be tilted at a downward angle.

At operation 420, liquid within a pouring device may be dispensed out of a nozzle through a dispensing port while air enters the nozzle via an air vent, wherein the air vent is positioned below the dispensing port when the liquid is poured out of the nozzle.

At operation 430, the air entering the nozzle may fill the space previously occupied by the poured liquid within the shaft and the corrugated portion, which may allow the air to fill the vacuum at a location more proximate to the dispensing point of the liquid.

At operation 440, the liquid may be poured out of the nozzle in a continuous and smooth manner.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A pouring device comprising:

a corrugated portion that is configured to increase and decrease in length;

a tapered portion positioned on a distal end of the congregated portion, a shaft positioned on a distal end of the tapered portion, the nozzle having a first diameter;

a sidewall positioned across a chord of the shaft to partition the inner diameter of the shaft into a first portion and a second portion, the chord being a straight line having a first endpoint at a first position on a circumference of the shaft and a second endpoint at a second position on the circumference of the shaft, the sidewall having a width that is less than the first diameter, wherein the first portion is larger than the second portion, wherein the shaft has a first length extending from the distal end of the tapered portion to a distal end of the pouring device, and the sidewall has a second length, the first length being greater than the second length, wherein a proximal end of the sidewall is positioned between a proximal end and a distal end of the shaft, and distal end of the sidewall is positioned between the proximal end and the distal end of the shaft.

2. The pouring device of claim 1, wherein an upper surface and the lower surface of the sidewall include grooves.

3. The pouring device of claim 2, wherein a distal end of the sidewall includes an indentation extending from the upper surface to the lower surface.

4. The pouring device of claim 3, wherein the indentation is aligned with the grooves.

5. The pouring device of claim 1, wherein the tapered portion has a third length, the third length being shorter than the first length.

6. The pouring device of claim 5, wherein the corrugated portion has a fourth length, the fourth length being longer than the first length.

* * * * *